US005974751A

United States Patent [19]

De Zen

[11] Patent Number: 5,974,751

[45] **Date of Patent: *Nov. 2, 1999**

[54] HOUSING SYSTEM WITH STRUCTURAL CORED HOLLOW COMPONENTS

[76] Inventor: Vittorio De Zen, 300 Greenbrook Dr., Woodbridge, Ontario, Canada, L4L 1A6

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/737,746

[22] PCT Filed: Apr. 24, 1995

[86] PCT No.: PCT/CA95/00221

§ 371 Date: Nov. 21, 1996

§ 102(e) Date: Nov. 21, 1996

[87] PCT Pub. No.: WO95/33106

PCT Pub. Date: Dec. 7, 1995

[30] Foreign Application Priority Data

May 27, 1994 [CA] Canada ..... 2124492

[51] Int. Cl.[6] ..... E04B 2/86

[52] U.S. Cl. ..... 52/439; 52/309.17; 52/737.6; 264/154; 264/209.1

[58] Field of Search ..... 52/439, 220.2, 52/433, 733.2, 736.1, 737.6, 284, 282.1, 382.2, 309.15, 309.17; 264/239, 176.1, 154, 209.1

[56] References Cited

U.S. PATENT DOCUMENTS

| | | | |
|---|---|---|---|
| 1,958,124 | 5/1934 | Bemis | 52/733.2 |
| 1,960,961 | 5/1934 | Thomas | 52/733.2 |
| 3,284,971 | 11/1966 | Attwood | 52/439 |
| 3,662,507 | 5/1972 | Espeland | 52/270 |
| 3,950,902 | 4/1976 | Stout | 52/91.1 |
| 3,992,839 | 11/1976 | La Borde | 52/275 |
| 4,536,360 | 8/1985 | Rahrig | 264/142 |
| 4,557,091 | 12/1985 | Auer | 52/282.1 |
| 5,216,863 | 6/1993 | Nessa et al. . | |
| 5,311,718 | 5/1994 | Trousilek | 52/425 |
| 5,465,545 | 11/1995 | Trousilek | 52/425 |

FOREIGN PATENT DOCUMENTS

| | | |
|---|---|---|
| 0 171930 | 2/1986 | European Pat. Off. . |
| 320745 | 6/1989 | European Pat. Off. . |
| 2007695 | 1/1970 | France . |
| 2544856 | 4/1984 | France . |
| DE 2657106 | 3/1980 | Germany . |
| 3234489 | 8/1984 | Germany . |
| 3003446 | 4/1987 | Germany . |
| 2193465 | 2/1988 | United Kingdom . |
| WO 85 00396 | 1/1985 | WIPO . |

*Primary Examiner*—Beth A. Aubrey

[57] ABSTRACT

Elongated extruded thermoplastic hollows structural components of rectilinear cross section formed for interlocking assembly for use in erecting a modular building on a supporting base, characterized in that each said component being a coextraction of a substrate including reprocessed plastic material and a thin smooth protecting thermoplastic skin covering wall surfaces of said component which are exposed when same is interlocking assembled with mating components, each said component being cored to provide a predetermined pattern of spaced holes along the length of the walls thereof which become internal walls when same in interlockingly assembled with mating components and the holes of mating components being in registration to provide internal flow passages therebetween with the corings providing a source of substrate reprocessed plastic feed stock.

27 Claims, 12 Drawing Sheets

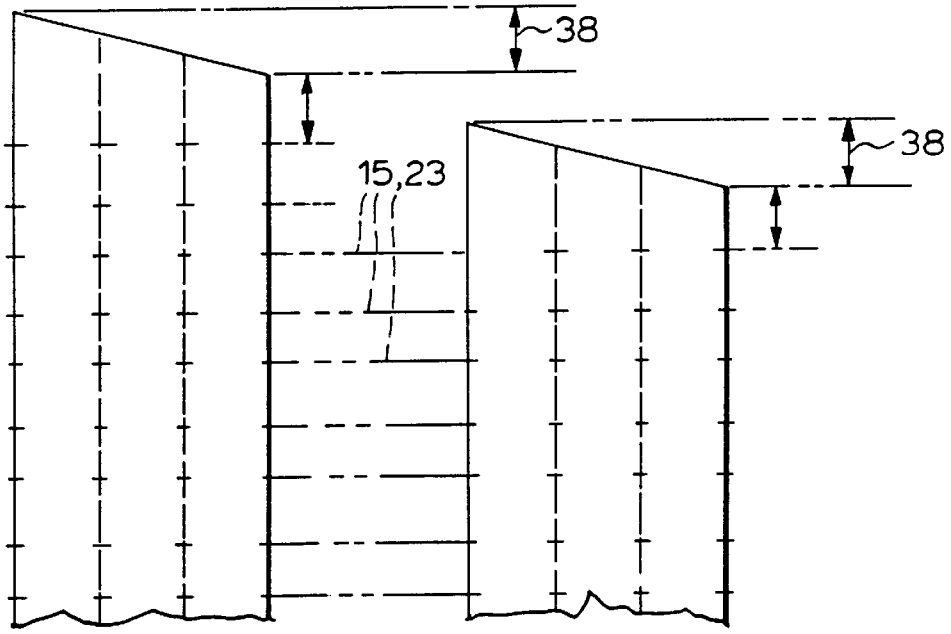
FIG. 8.
FIG. 7.
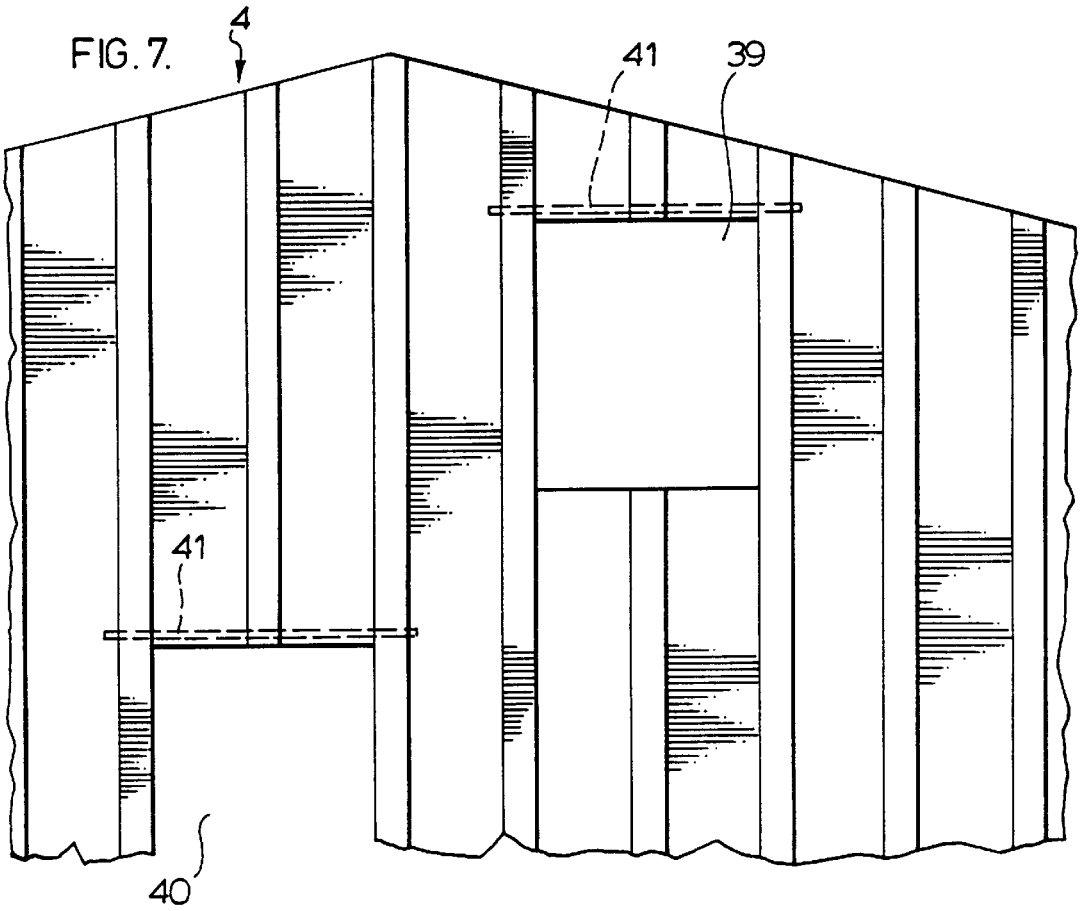

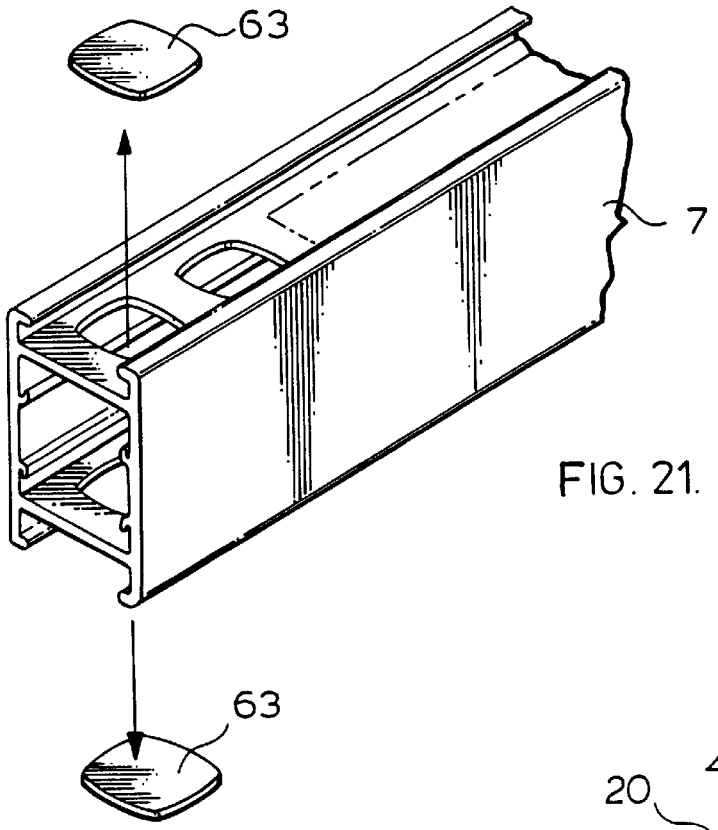
FIG. 21.
FIG.14.
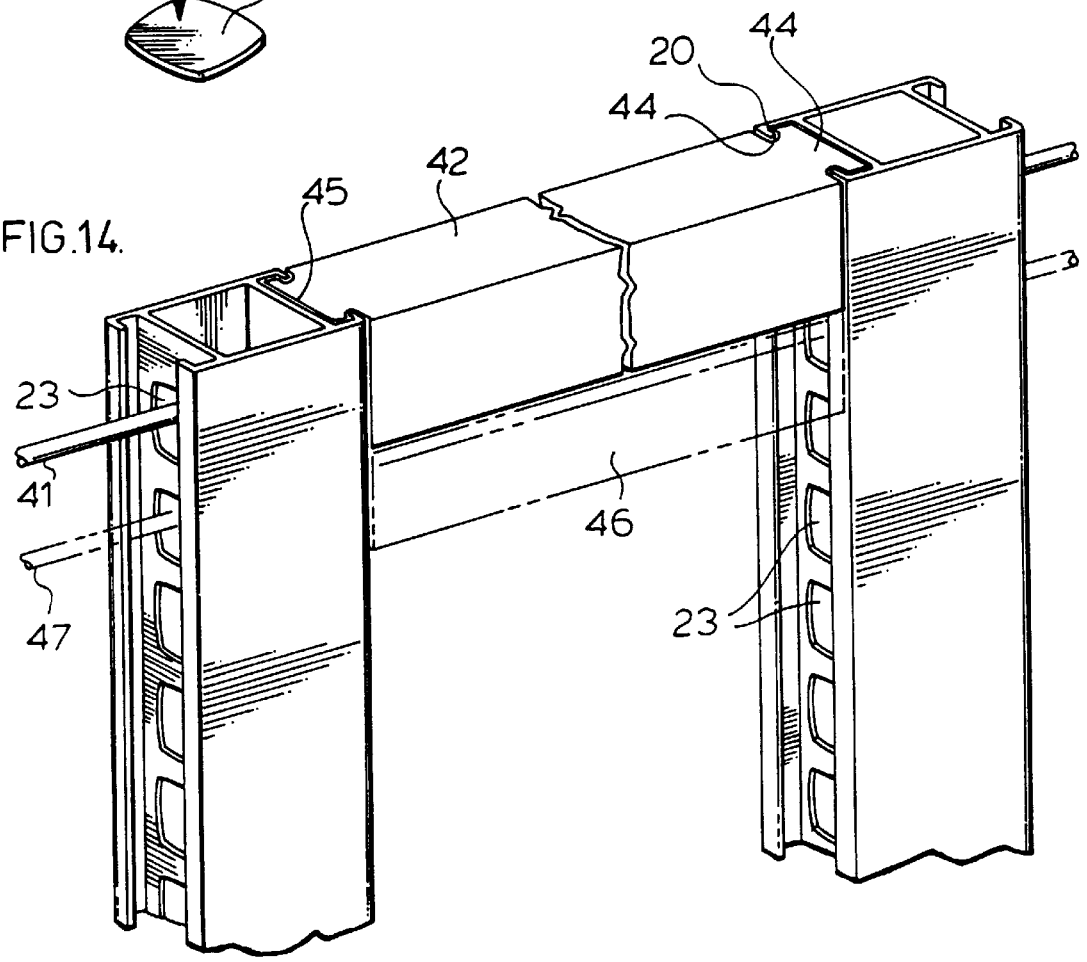

5
52
53
54
49
50
48
51

HOUSING SYSTEM WITH STRUCTURAL CORED HOLLOW COMPONENTS

FIELD OF THE INVENTION

This invention relates to a modular building system of the type disclosed in my Canadian Application Serial Number 2,070,079, filed May 29, 1992, where houses or other building structures can be easily and quickly erected using prefabricated extruded thermoplastic interlocking structural components.

The present invention is further to my Canadian Application Serial No. 2,097,226, filed May 28, 1993, which provides for internal communication between the interlocking structural components disclosed in my said Application Ser. No. 2,070,079 and is directed to providing a modular building system which enables the erection of modular houses or other building structures having high aesthetic appeal while providing superior structural strength at significantly lower costs than heretofore possible.

BACKGROUND OF THE INVENTION

There have been provided building elements which are principally limited to the construction of walls which when assembled together present hollow interiors intended to receive concrete or the like and the elements are provided with holes which afford internal communication between adjoining elements through which the concrete can flow. For example, German Specification DE C23003448 discloses the use of a large series of hollow square rectangular elements constructed from impregnated pressboard which are stood up side by side and then tied together by means of tie rods. The adjacent side walls of these blocks have holes therethrough so that when concrete is introduced therein it can flow therebetween to interconnect same. When such elements are used as ceilings, the holes therein are upwardly facing so that there is no provision for lateral concrete flow between adjoining elements. These hollow blocks or elements are awkward to assemble and require a great deal of handling of a large number of individual elements in their assembly into a wall formation. Moreover, their manufacture is relatively expensive requiring the assembly of the pressboard into square or rectangular form and the resulting wall does not present an impervious smooth aesthetic wall surface.

A similar brick-like building element is disclosed in German Specification DE C2324489 which also has similar disadvantages.

U.S. Pat. No. 5,216,863 discloses an elongated thin flexible walled cylinder-like shaped formwork elements with the elements being mutually interconnectable and when interconnected they provide a series of adjoining closed cylinders. These cylinders are internally connected through openings so that when concrete is poured therein it will flow therethrough to create a wall formed by a series of interconnected vertical concrete columns encompassed by the thin formwork walls which may be left in place or discarded.

The formwork walls may be formed of polyvinyl chloride (PVC) to give the columns an attractive surface coating.

Again, these individual formwork elements require a great deal of handling and, if they are formed of PVC, only virgin material can be used and the material cut out to provide the apertures becomes waste material.

These formwork elements do not have individual structural integrity but require mutual interconnection and their cylindrical form to give them any structural substance capable of withstanding the introduction therein of wet concrete.

SUMMARY OF THE INVENTION

According to the present invention, a unique modular building system is provided through the use of novel hollow rectilinear extruded thermoplastic precision interlocking structural components which have a composite structure and which have been cored in a manner to allow optimum continuous interior communication therebetween when same are connected in interlocking engagement while still maintaining their individual structural integrity, the composition of the extruded components being such that the cored material can be returned for reuse in the extrusion process without impairment to the aesthetics of the components. As as result the invention provides a most important material cost savings while at the same time providing a very significant component weight reduction to reduce shipping costs and facilitate handling during both shipping and building erection.

In this connection, according to the invention, the extruded thermoplastic components are formed as a coextrusion of a substrate which may constitute or contain reground thermoplastic material and a thin outer protective and aesthetically appealing skin of virgin material covering the exterior exposed surfaces thereof whereby the material removed by cutting, punching, drilling or the like in providing the cored openings therein can be recycled to be used in the extrusion of the substrate of the co-extrusion without adversely affecting the integrity or visual appeal of the components.

Further, in this connection, the invention provides for a skin component which is fully compatible with the substrate component so that when same is recycled for subsequent substrate extrusion the substrate will not be adversely affected.

The invention also provides for the maintenance of correct rectilinear form and precision interlock by co-extruding components subject to distortion on coring out of rectilinear slope to be returned thereto in the coring operation.

The invention further provides a system of coring wherein when the interlocking components are interconnected the cored openings therein are in registration and this registration is carried out throughout all levels of the house or building formed therefrom.

This arrangement of registration or alignment of the cored openings of the interlocking components throughout the building structure not only provides, for example, for the free flow of concrete between interconnected components forming the building walls but also enables simple standard reinforcing bars or rods to be introduced interiorly of the interlocked components through the aligned openings to provide added strength such as tying together anchor rods anchoring the building walls to a concrete base or foundation, providing reinforced support in lintels over doors or window openings, and tying roofs to walls.

In this connection, to provide the registration of the cored openings throughout a building having the usual sloping roof, according to the invention, their spacing or center-to-center span is made a function of the slope of the roof.

To provide for removal of the optimum volume of material by the coring of the openings commensurate with adequate retained component strength for handling and stacking, the cored openings are shaped to eliminate stress fracture around their perimeters and sufficient web spanning therebetween is left to preclude breakdown between the openings and provide sufficient web strength to permit stacking of the components.

BRIEF DESCRIPTION OF THE DRAWINGS

FIG. 7 is a broken away partly diagrammatic elevational view of an end wall of a building constructed using the panels and box connectors disclosed in FIGS. 2 and 3 and 4 and 6 respectively;

FIG. 8 is a diagrammatic view illustrating how the cored openings are in registration throughout the entire building when the structural components are assembled;

FIG. 14 is a broken away perspective view of a wall opening for receiving a window, door or the like and illustrating how the aligned cored openings in the interlocking cored members permits the use of rebar to provide the strength to the lintel to carrying the overhead loading;

FIG. 21 is a broken away perspective view illustrating that the coring of the extruded box connector produced two cored discs both of which are core material to be reground and returned to the core feed hopper;

DETAILED DESCRIPTION ACCORDING TO THE PREFERRED EMBODIMENTS OF THE PRESENT INVENTION

Figure 1:
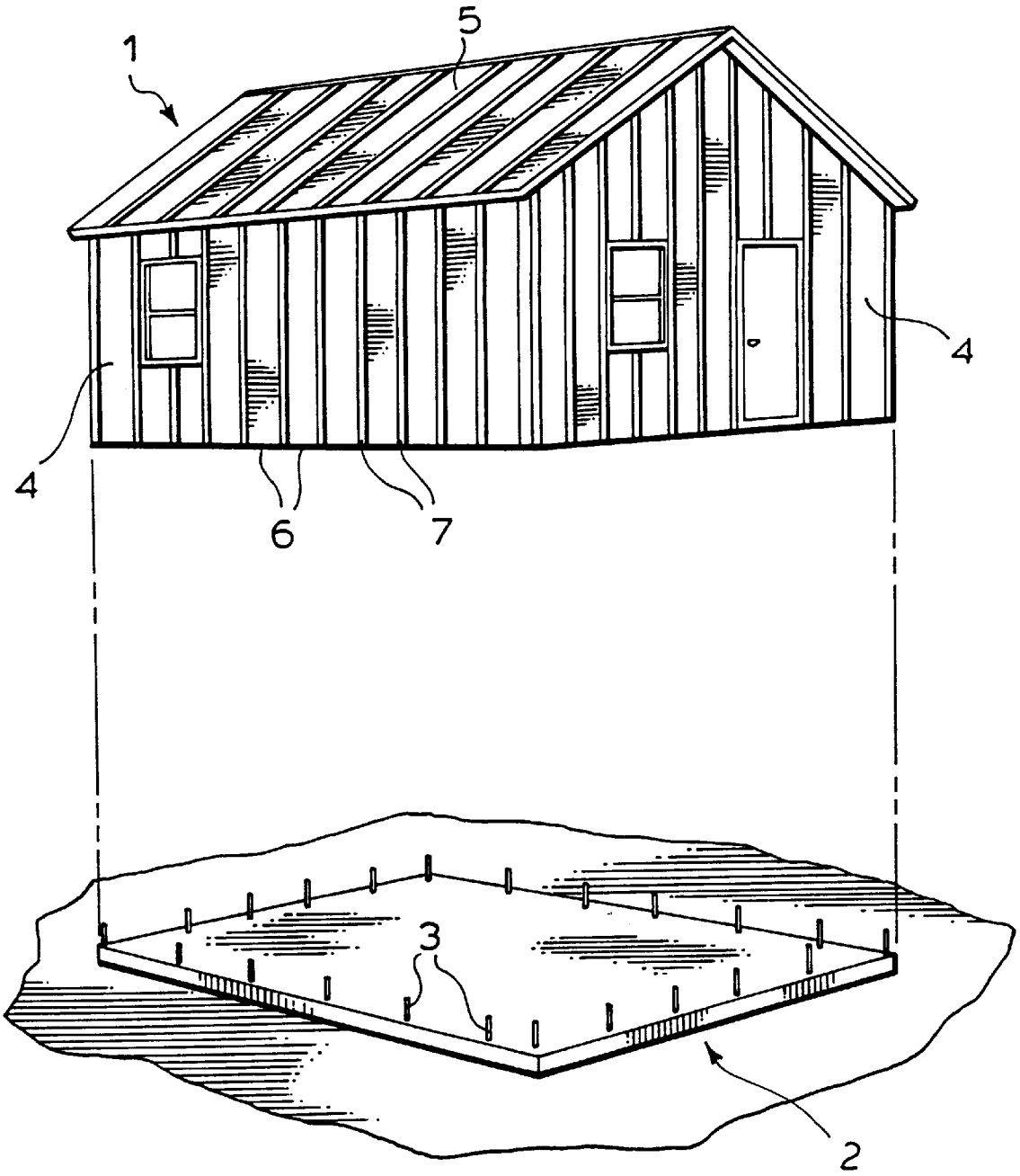
FIG. 1 is a perspective view of a simple house constructed from the structural components of the invention principally thermoplastic extruded panels and box connectors and showing the house raised off its supporting base from which anchor rods extend.

With reference to FIG. 1, there is shown a simple house 1 lifted off its support base 2 which is preferably a concrete pad from which project upwardly extending tie rods 3 which can extend upwardly as high as desired.

The basic components of the walls 4 and the roof 5 of the house comprise rectilinear panels 6 and box connectors 7.

Figure 2:
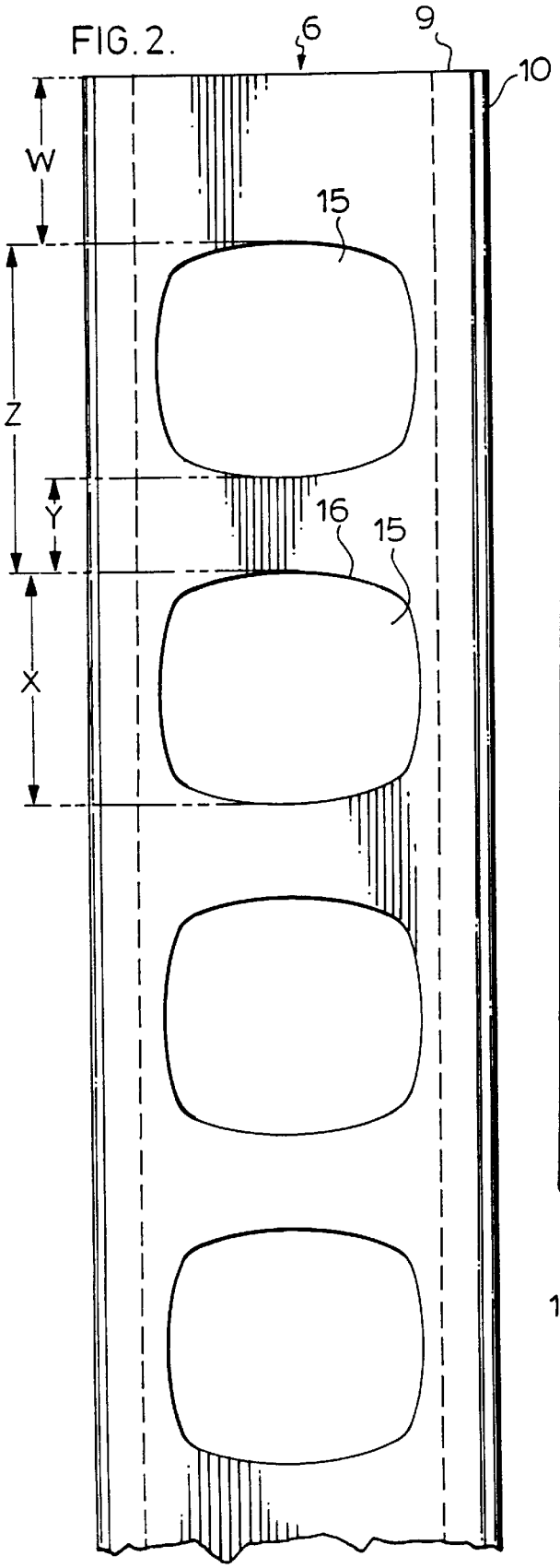
FIG. 2 is a broken away edge elevational view of a panel member embodying the invention.
Figure 3:
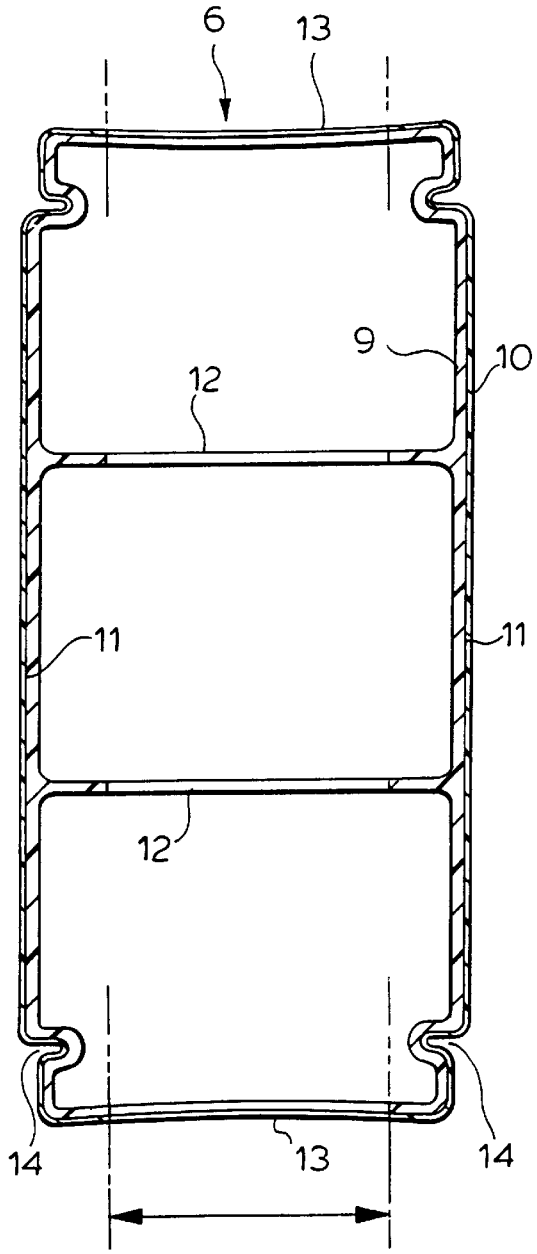
FIG. 3 is a top plan view of the panel of FIG. 2.
Figure 4:
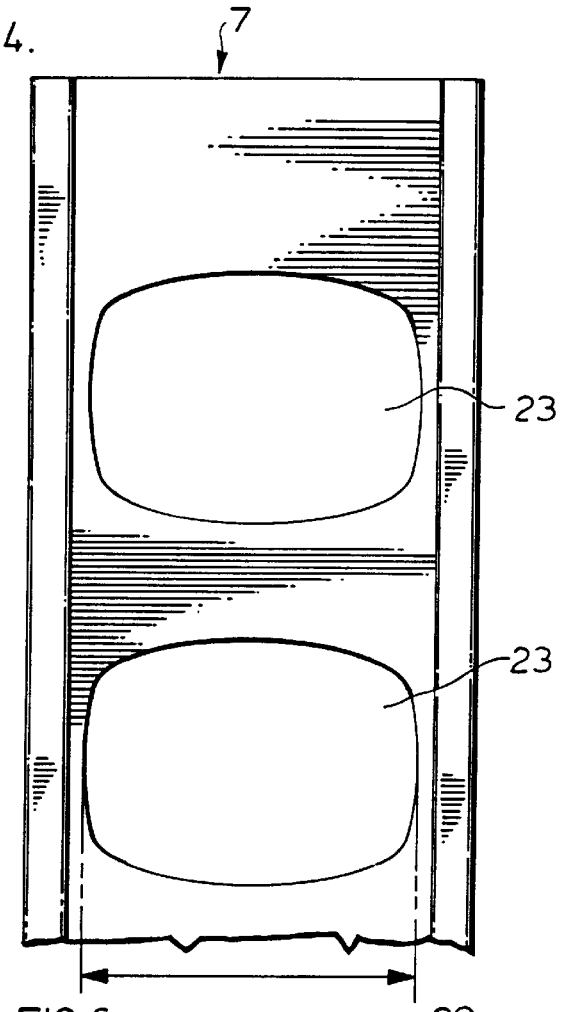
FIG. 4 is a broken away edge elevation of a box connector embodying the invention.
Figure 6:
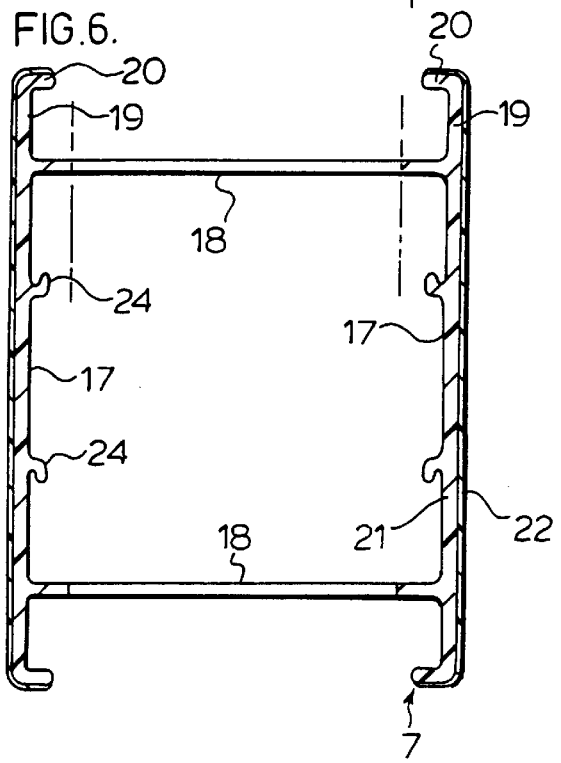
FIG. 6 is a top plan view of the extrusion of FIG. 5 after coring.

The panels 6 are illustrated in FIGS. 2 and 3 and the box connectors 7 are illustrated in FIGS. 4 and 6.

Figure 10:
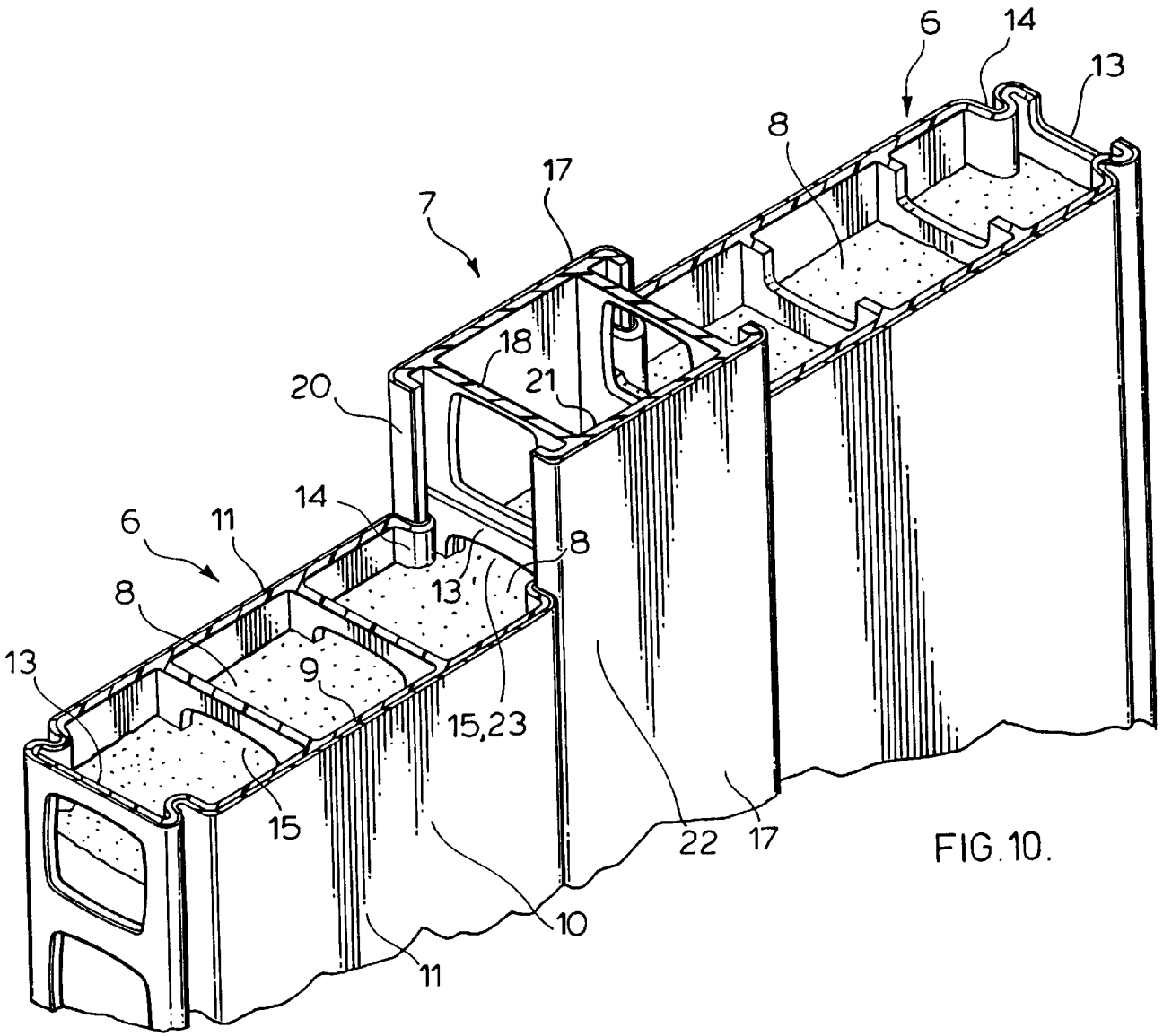
FIG. 10 is a perspective sectional view taken at different heights of a wall section comprising a pair of panels connected by a box connector with the wall section having concrete introduced therein.

The tie rods 3 are arranged to extend preferably up into the box connectors 6 and when the walls are filled with concrete 8, as illustrated particularly in FIG. 10, the tie rods 3 tie the walls of the house to the concrete pad 2.

The panels 6 are longitudinal extrusions comprising a core 9 and a co-extruded outer skin 10 covering the surfaces of the panel which are exposed when the panel is assembled into a wall, roof, or other structure.

The panel 6 has parallel side walls 11 joined by transverse webs 12. The side edges of the panels are bridged by edge walls 13 which are slightly concave. Adjacent to the edge walls 13 the panel is provided with opposing inwardly projecting grooves 14 extending throughout the height or length of the panel and the width of the panel outwardly from the grooves 14 to the edge walls 13 is slightly reduced. Because the panels when utilized as wall members are intended to be filled with concrete or when used as roof members can be internally reinforced very important cost savings can be effected by coring the panels to remove a significant volume of the plastic material therefrom while still maintaining structural integrity for handling, shipping, erecting and maintaining rectilinear form under the pouring of concrete therein. When the concrete has set a permanent wall structure is formed with the wall having a highly attractive smooth planer surface finish.

The ability to maintain sufficient structural integrity and aesthetic appeal as aforesaid while removing a significant volume of cored material resides in the fact that the panel is a co-extrusion comprising a core for strength and an outer skin covering exposed surfaces both protecting against impact and isolating it from weathering while giving it aesthetic appeal. As a result, the appearance of the core is immaterial and the homogeneity of the core is not of critical importance with the result that the invention enables the material removed in the coring operation to be reground or reprocessed and subsequently used as core feed stock in the extrusion of subsequent panels. Thus, the invention provides tremendous cost savings without adversely affecting the structural characteristics of the panel or the quality of the panel finish either from the standpoint of appearance or functionality since the skin 10 will continue to be extruded as virgin material.

A particularly advantageous pattern of cored openings in the panels 6 according to the invention is illustrated in FIG. 2. Each of the cored openings 15 extends substantially the width between the opposing grooves 14 and is shaped somewhat like an oval whose ends have been somewhat flattened so that it is symmetrical both about an axis running longitudinally of the panel and an axis running transversely of the panel with the peripheral wall 16 of the opening being essentially curved throughout its peripheral extent and free of any angles which would give rise to fracture stress.

As illustrated in FIG. 1, the usual house structures, for example, to be built applying structural components of the invention have gables involving sloping roofs. A typical roof slope might, for example, be 14 degrees. By choosing a meter as a practical modular base dimension or unit (the distance between center lines of box connectors connected to opposite edges of a panel) and with the requirement according to the invention that the cored openings of the interconnected structural components be as large as practical and in registration throughout the house, the pattern of openings 15 spaced along the length of the panel would be as follows.

The critical starting point for the cored openings is the upper end of the panel and leaving a predetermined distance between the upper end of the panel and the top of the first cored opening, eg. 43.20 millimeters (dimension W), the depth of the cored opening in the direction of the longitudinal axis of the panel was selected at 58.30 millimeters (dimension X) and the spacing between adjoining cored openings was set at 25.00 (dimension Y) millimeters. Therefore, the distance from the top edge of one cored opening to the top edge of the next cored opening would be 83.30 millimeters (dimension Z) which is the tangent of the angle 14 degrees times the basic modular unit 1 meter.

A practical panel unit would have a width of 100 millimeters a sidewall thickness of the order of 2.8 millimeters comprising a core of approximately 2.4 millimeters and a thin skin of the order of 0.4 millimeters and a web thickness of the order of 2.3 millimeters.

For the panels which are to be used in the forming of the wall formations, the core extrusion is preferably a polyvinyl chloride containing a reinforcing and expansion controlling agent. This agent preferably is selected from one or more of mineral fibers, small glass fibers and calcium carbonate.

Since, as explained, the exposed surfaces of the panel are enveloped in the co-extruded outer skin, the core material can be reground or reprocessed material. With the coring of the panel as described, some 16 percent by volume and weight of the material of the extruded panel is recovered for regrinding and reprocessing as core feed stock.

The skin 10 of the panel preferably comprises polyvinyl chloride which may be rigid polyvinyl chloride or cap stock using virgin PVC resin which may include various stabilizers and additives as desired to resist ultraviolet radiation, provide impact resistance add colour or the like but this skin must be free of reprocessed or reground thermoplastic materials.

It is to be noted that the skin component 10 as described being basically a polyvinyl chloride is fully compatible with the core or substrate component as described which employs polyvinyl chloride so that when a mixture of skin and substrate is reprocessed and reused as substrate feed stock the resulting substrate will not be adversely affected.

With the sidewalls 11 of panels 6 bridged by the edge walls 13 and webs 12 the integrity of the accurate panel extrusion can be maintained without distortion under the coring operation despite the removal of the large volume of material in forming the pattern of openings discussed above. When, however, it comes to coring similar openings in the box connectors 7, the coring tends to distort the box connectors making them difficult to interlock with the panel. In this connection, it will be appreciated that the box connector 7 illustrated in FIG. 6 has parallel sidewalls 17 connected by webs 18 defining a square. The walls 17 have flange extensions 19 with inturned oppositely registering fingers 20 which are adapted to interlock in the grooves 14 of the panels.

Again, the box connectors are formed as co-extrusions of a core 21 and a co-extruded skin 22 covering the surfaces of the box connector which are exposed when same is interlocked with the panels.

Figure 5:
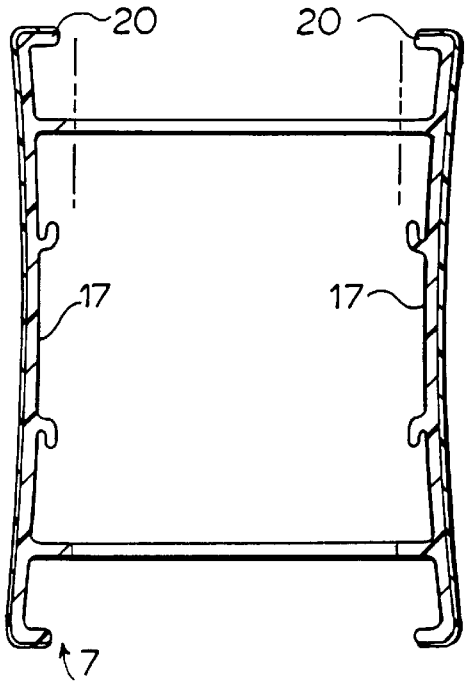
FIG. 5 is a top plan view of an extruded box connector prior to coring.

To accommodate the coring and produce the desired parallel sidewalls and accurately spaced registering fingers 20 in the final product, the box connectors are extruded in the shape shown in FIG. 5 with the walls 17 concaved and the fingers 20 spread apart so that in the coring operation which tends to close the fingers 20 a balance is achieved to provide the required accuracy so that an accurate readily assembled sliding fit can be achieved in assembling the panels and box connectors. Because the panels are reduced in width outwardly of the grooves 14, the sidewalls 17 of the box connectors and the sidewalls 11 of the panels 6 are flush to provide a smooth flush surface formation.

The cored openings 23 in the box connectors have essentially the same shape, dimensions and pattern as discussed above in connection with the panels 6. However, it will be appreciated that the spacing between the inturned fingers 20 of the box connectors is slightly greater than the spacing of the internal grooves 14 of the panels so that the cored openings 23 can have a slightly greater dimension transversely of the longitudinal axis of the box connector than the cored panel openings in the same direction. Thus, a slightly greater volume of material can be removed for reprocessing and reuse from the box connectors than from the panels in the coring operation with the corresponding decrease in material costs.

Where the upper surfaces of the panels and box connectors are sloped to provide the sloping or gable end wall surface, the distances measured down from the angled tops of the panels and box connectors to start the cored openings is measured on the box connectors from the upper edge of the top angle and with the panels is measured from the lower edge of the top angle.

The box connector shown in FIG. 6 is provided with internal guide ledges or slideways 24 for receiving wiring enclosures and the like not shown.

The square cross section of the box connector has an inherent rigidity and therefore has less need for the use of reinforcing constituents in the core 21 than the panels although they may be used as desired.

The skin 22 of the box connectors corresponds to the skin 10 of the panels 6.

Figure 9:
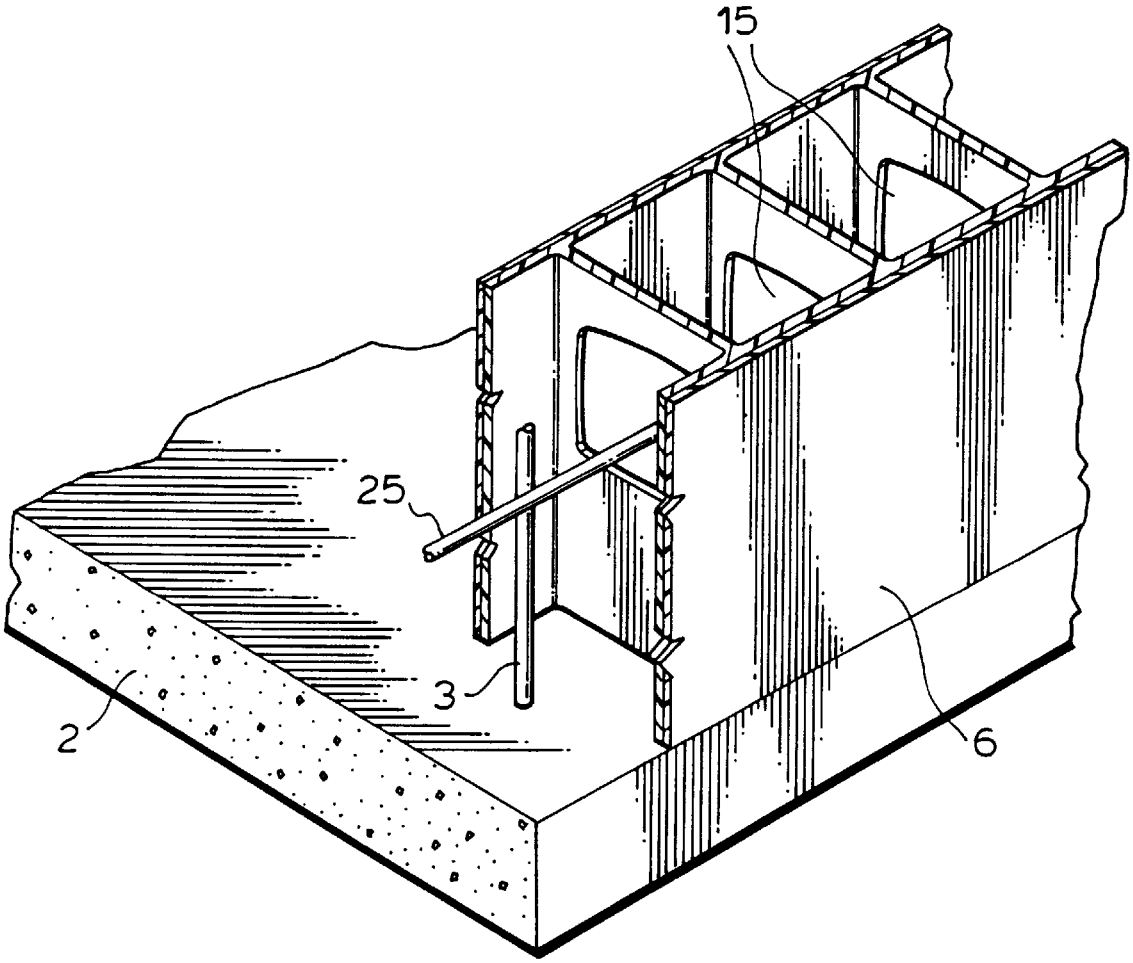
FIG. 9 is a broken away perspective view illustrating the use of common rebar extending through the registered cored openings to tie the anchor rods projecting from the base when the walls are filled with concrete as illustrated in FIG. 10.

As mentioned, the spacing of lowermost cored openings from the bottom of the panels and box connectors is not critical so long as the bottom opening is spaced above the bottom of the component. The spacing of the cored openings from the bottom may be substantially greater (or less) than the fixed spacing between the openings moving down from the upper ends of the components since, as illustrated in FIG. 9, the tie rods 3 anchored in the concrete pad 2 have a substantial upward extent and can extend to any desired height up into the wall formation. These tie rods 3 may be connected or tied together by one or more horizontally extending rebars 25 shown projecting through the aligned panel openings 15, corner box connector up into which the tie rod 3 extends having been removed for clarity. Reinforcing bars such as the rebar 25 can simply be suspended in desired position by a wire or other tie until the concrete has been poured and the tie rod and the rebar arrangement embedded in the concrete.

FIG. 10 illustrates a wall section where a box connector 7 is interlocked with two panels 6. These components are interlocked by sliding one longitudinally relative to the other with the box connector fingers 20 engaging in the grooves 14 of the panels to provide a precision interlock with the smooth outer faces of the panels and box connector flush. By providing the slight concavity to the panel edge walls 13, a clearance is provided to prevent binding between these edge walls and the box connector webs 18.

As seen in FIG. 10, the aligned or registering cored openings 15 and 23 provide very large flow passages so that concrete 8 when introduced at any point will flow freely laterally through the interlocked components and when set will bind them in interlocked relation as well as providing a permanent wall structure encompassed within the panel walls 11 and box connector walls 17 which present the protective outer covering formed by the co-extruded skins 10 and 22 of the panels and box connector respectively.

The co-extruded skins present the pristine appearance of the wall masking any blemishes in the cores 9 and 21 of the panels and box connector respectively which contain reprocessed or reground plastic materials and at the same time these cores provide a protective barrier to prevent bulging of the panel and box connectors out of rectilinear shape and isolating the concrete from contact with the outer skins.

Figure 11:
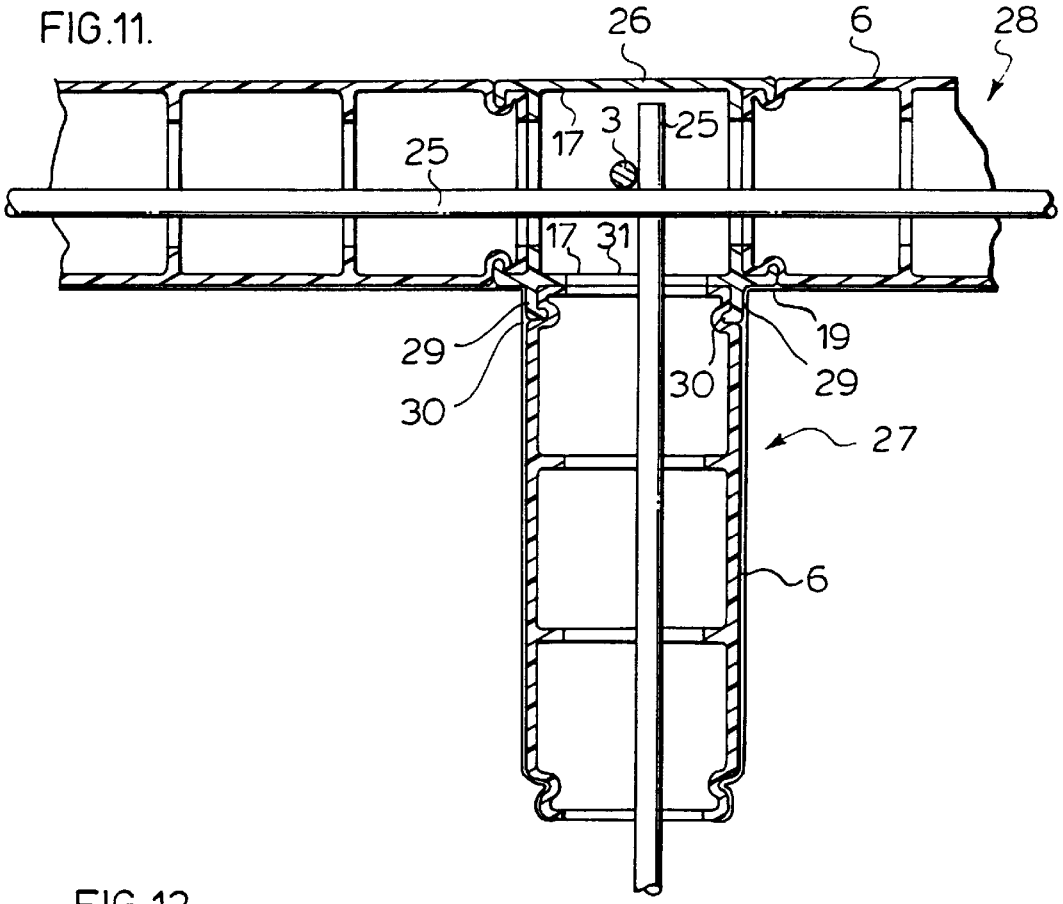
FIG. 11 illustrates a right angular wall section connected to a linear wall section through a three-way box connector and illustrating the use of rebar to tie the sections together and with a tie rod projecting upwardly from the wall base or foundation.

FIG. 11 illustrates how the panels 6 may be interlocked by means of a three-way box connector 26 to form a right angularly arranged wall 27 interlocked with a through wall 28. Again, the wall arrangement can be anchored to a concrete base by means of tie rod 3 and reinforced by rebar 25.

Box connector 26 is provided with flanges 29 in addition to the flanges 19 and these flanges have locking fingers 30 for interlocking engagement with the panel grooves and one of the walls 17 which now becomes an internal wall in the wall system of FIG. 11 is provided with the appropriate cored openings 31 to allow for free concrete flow between the building walls 27 and 28.

It will be understood that the box connector may be a four-way box connector, not shown, for connecting a wall structure on the opposite side thereof to the wall 27. Also a corner box connector would be provided by having flange extensions 19 and fingers 20 only at one side of the box connector in conjunction with the flanges 29 and fingers 30 in right angular relation thereto and omitting the coring of the wall opposite the one set of flanges and fingers 19 and 20.

Figure 12:
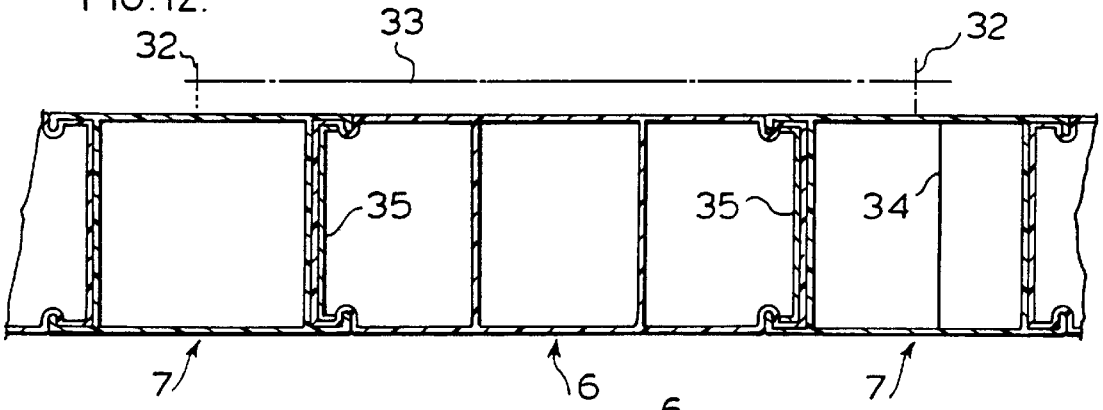
FIG. 12 is an end view of a roof section comprised of a panel connected to two box connectors embodying the invention and showing one form of roof reinforcement. The distance from center line to center line of the box connectors being the selected modular base unit for the housing system chosen as one meter with the width of the panels and box connectors being selected at 100 millimeters.

FIG. 12 illustrates a pair of box connectors 7 interlocked with a panel 6 to be used as a roof segment. In this case the inherent structural integrity and rigidity of the interlocked sections despite their coring enables them to carry normal roof loading due to the fact they are comprised of a coextrusion of a core, reinforced as required, and a protecting skin. Further, their hollow form allows for air circulation therethrough for cooling under warm climatic conditions.

As illustrated, the distance between the center line 32 of the box connectors represented by the line 33 is the modular base unit of the building system of the invention which has been selected at one meter and line 34 represents the modular wall spacing of the panels and box connectors set at 100 millimeters.

Figure 13:
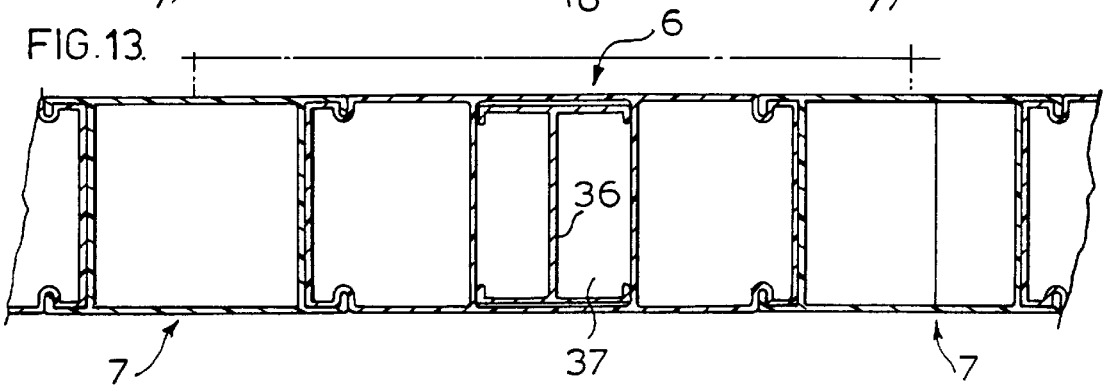
FIG. 13 is a view similar to FIG. 12 but illustrating an alternative form of roof reinforcement.

If desired, the roof members may be reinforced with metal reinforcements 35 inserted at the side edges of the panels in the form of elongated wide U-bars or channels. Alternatively, for example, as illustrated in FIG. 13, a metal H-bar 36 may be introduced into the central chamber 37 of the panels 6. It will be appreciated other insert stiffeners may also be used as desired.

FIG. 8 is a diagrammatic view illustrating how the alignment or registration of the panel and box connector openings 15 and 23 respectively is carried out throughout the entire building structure regardless of the difference in their length to produce sloping surfaces such as designated at 38.

FIG. 7 is a broken away diagrammatic view looking at an end gable wall of a building and illustrating the provision of openings therein such as the opening 39 for a window and the opening 40 for a door.

The provision of the aligned openings as illustrated in FIG. 8 allows for the use of rebar 41 to be used in the reinforcement of lintels bridging these openings as more particularly shown in FIG. 14.

The lintel 42 shown in FIG. 14 is a hollow rectangular form and is formed with end interlocks corresponding to those provided on the panels 6 comprising inwardly projecting grooves 44 for receiving the inturned fingers of the spaced box connectors and, in effect, tongue portions 44 engage behind the box fingers 20.

In effect, the lintel is a small panel with the edge walls 45 provided with cored openings, not shown, to register with the box connector openings 23 so that when concrete is poured into the wall structure including the lintel 42 concrete will flow across and fill the lintel.

One or more reinforcing rods or rebar extending through the aligned box connector openings 23 and through the lintel 42 provide with the concrete when same is set, a strong rigid lintel structure spanning the opening between the box connectors to carry loads placed on the lintel.

As illustrated in dotted line, the depth of the lintel 42 may be increased as indicated at 46 and additional rebar 47 can be used.

Figure 15:
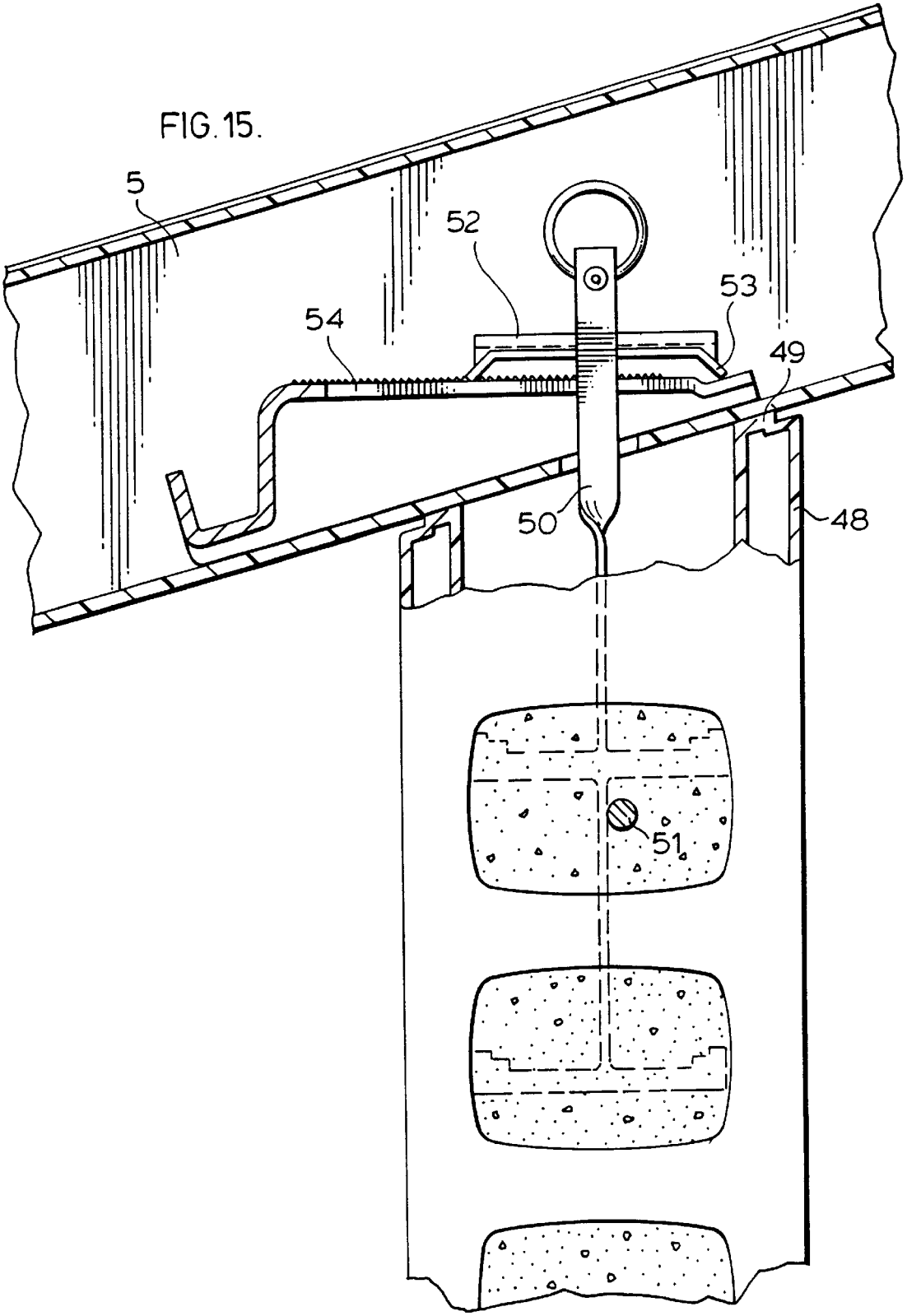
FIG. 15 is a broken away part vertical elevational part sectional view showing a sloping roof anchored to a wall cap by an anchor embedded in the concrete of the wall and a locking wedge and illustrating how anchors along the roof line can be tied together by rebar projecting through the aligned cored openings.

FIG. 15 illustrates how the use of the aligned cored openings of the box connectors and panels forming a wall having a wall cap 48 provided with sloping bearing surfaces 49 to which the lower end portion of a roof 5 is clamped enables the tieing of the roof anchors 50 together by means of longitudinally extending rebar 51.

In this connection, it will be understood that there will be a series of roof anchors 50 embedded in concrete within the box connectors along the length of a wall extending between the gabled end walls of a house.

As illustrated, anchor 50 projects upwardly through the roof 5 and carries a stop plate 52 under which is a spring 53 for engaging a wedge 54 which is inserted beneath the spring and stop plate to clamp the roof member to the bearing surfaces 49.

Figure 16:
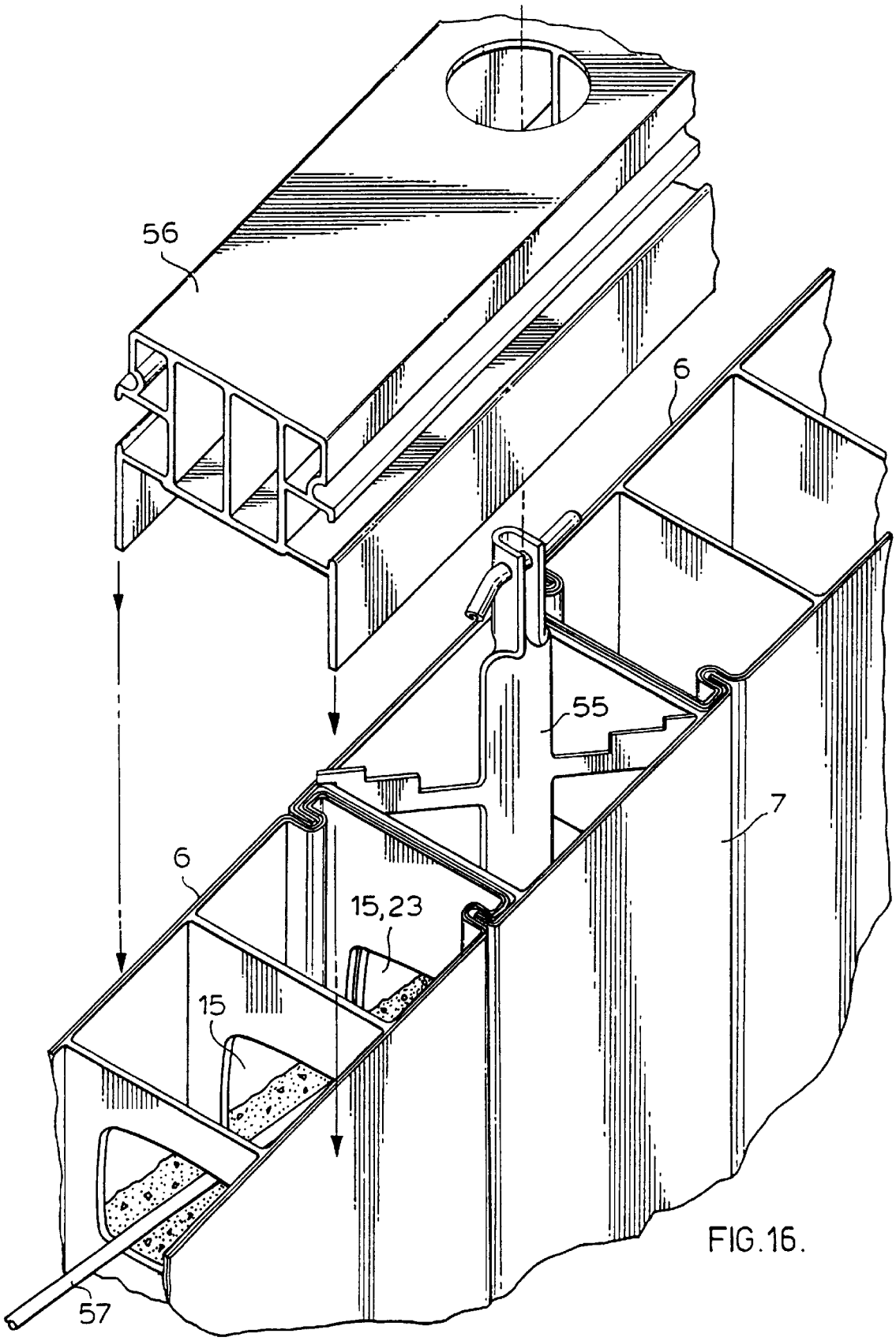
FIG. 16 is an exploded broken away perspective view of a sloping end gable wall illustrating the type of anchor used in conjunction with a wall cap member for anchoring the roof to the gable wall and illustrating how such anchors can be tied together through the use of rebar projecting through the aligned cored openings and embedded in concrete.

FIG. 16 illustrates how the carrying of the alignment of the cored openings 15 and 23 of the panels and box connectors respectively allow for the added securement of the roof anchors 55 used in the gable walls of a building to tie a roof supporting wall cap 56 and roof, not shown, to the gable wall.

The structure of the anchor 55 and the clamping arrangement utilized to clamp the roof and wall cap 56 in position are not part of the present invention, being one of my earlier inventions.

Suffice it to say that with the aligned cored openings 15 and 23 concrete introduced into the gable wall structure will freely flow between the interlocked panels and box connectors to lock same together and rebar 57 as desired can be projected through the registering openings to further reinforce the wall structure and tie the roof anchors 55 against lifting under roof wind loading.

Figures 17, 18:
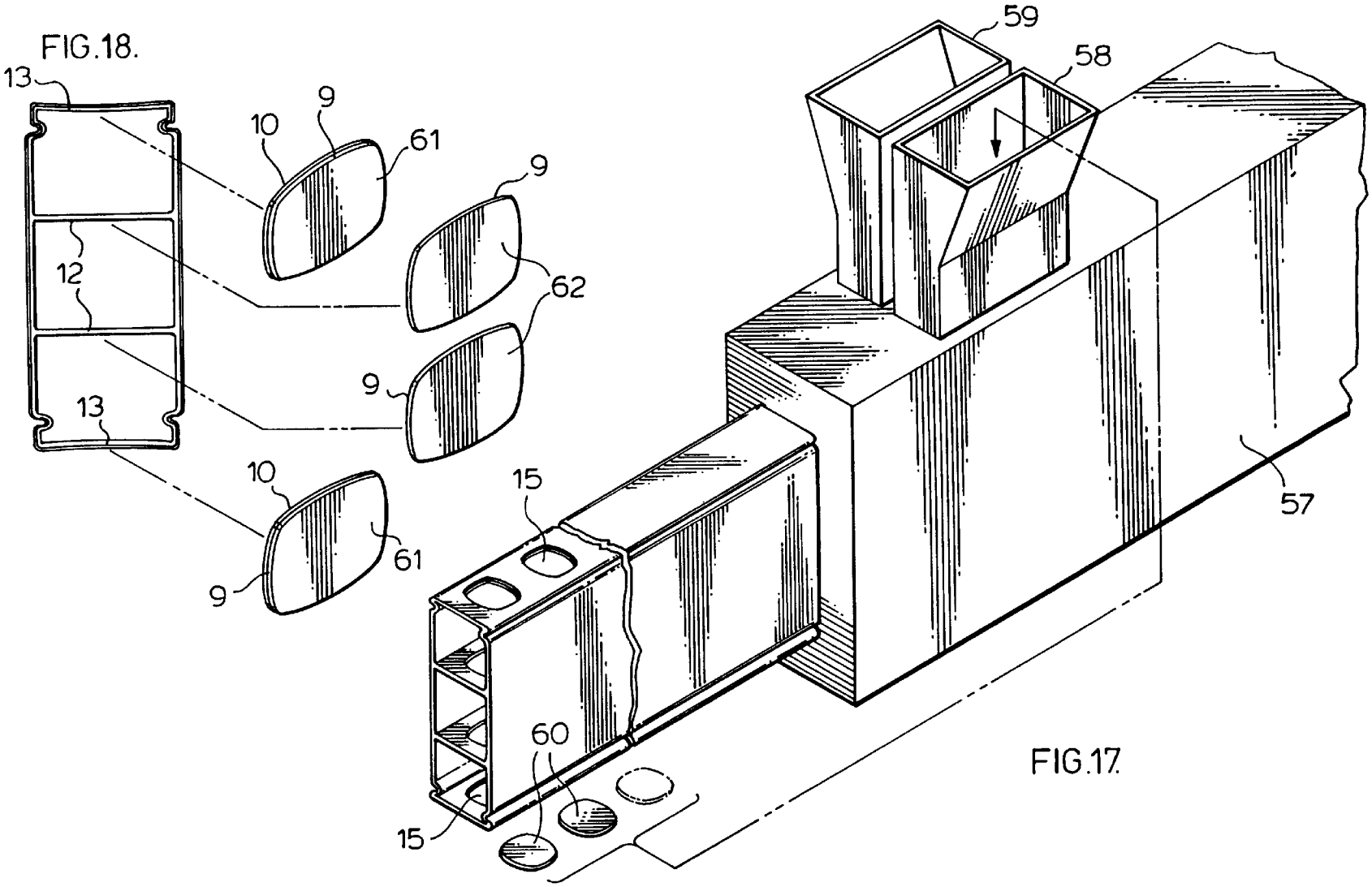
FIG. 17 is a diagrammatic view of an extruder for extruding the panels as a co-extrusion having an input core hopper feed hopper and an input skin feed hopper and illustrating the material removed in the coring operation being returned after being reground into the core feed hopper.
FIG. 18 is a view illustrating the four different sections removed by the coring of the panel the two outer sections being made up of core and skin and the two inner sections being solely core material.

FIG. 17 is a diagrammatic view illustrating an extrusion process for producing panels. As illustrated, the extruder 57 has an input feed hopper 58 for material used in extruding the core 9 of the panel formation while hopper 59 is used to provide the feed for the material used to extrude the skin 10 of the panel extrusion.

Following extrusion, the panel is cored and the coring may be carried out to simultaneously produce multiple sets of aligned cored openings 15, three being shown in FIG. 17. This cored material 60 is then reground or reprocessed and delivered back to the core feed hopper 58.

As illustrated in FIG. 18, the coring of each set of aligned panel openings 15 produces two discs 61 comprising core and skin material while discs 62 comprise only core material.

As illustrated in FIG. 21, when the coring of the box connectors 7 is carried out, the cored discs 63 comprise only core material. However, because of the use of the co-extrusion process to cover the exposed surfaces of the components with non-reprocessed or virgin material producing a smooth aesthetic outer appearance, the lack of homogeneity and unsightly appearance in the core material does not adversely effect the resulting extruded product. Moreover, the use of the smooth outer skin in the co-extrusion process facilitates the passage of the reprocessed core material through the extruding dies and reduces wear thereon.

Figure 19:
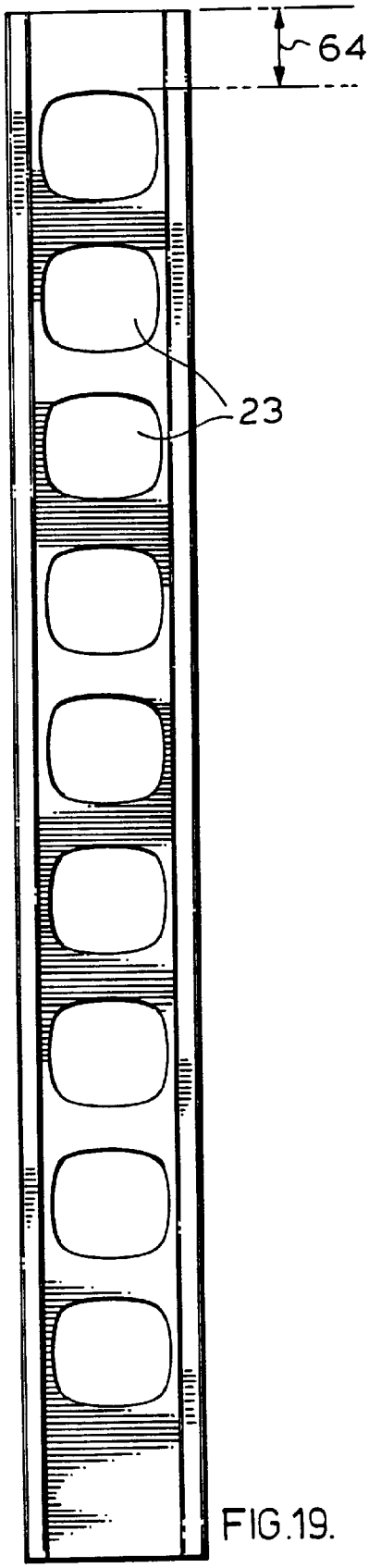
FIG. 19 is an edge elevational view of as an example a box connector illustrating that the reference point for starting the first coring is the upper end of the connectot to provide a fixed distance between this upward end and the starting point of the first cored opening and showing that coring ceases short of the lower end of the panel.
Figure 20:
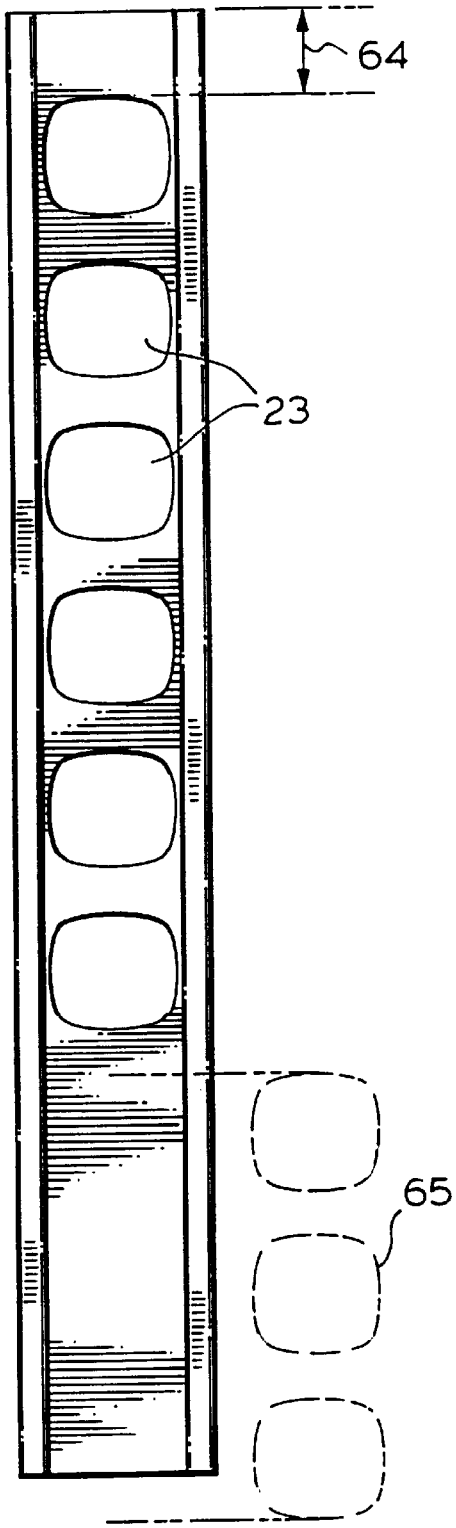
FIG. 20 is a view similar to FIG. 19 but illustrating that where multiple coring, in this case three at a time, is carried out coring is stopped if the lower most cored section would break through the lower end of the connector.

FIGS. 19 and 20 indicate that if multiple sets of cored openings are cored simultaneously the starting point from the top of the component will always be the same. However, the spacing of the lower most set of aligned cored openings from the lower end of the component will vary.

Thus, for example, as shown in FIG. 19, if three sets of cored openings are cored at one time in the coring operation, the starting point, as explained, for the first group of openings will be fixed at distance 64 from the top of the component. FIG. 19 illustrates a box connector but the same is equally true for a panel.

The coring is shown as being repeated three times to produce 9 sets of corings. In FIG. 20, which illustrates a shorter box connector, the starting group of cored openings 23 is again spaced the precise distance 64 from the top of the box connector but since there is not even room to effect the coring of the third group of corings illustrated in dotted line at 65, these corings are not made and the space of the lower most set of cored openings in the box connector FIG. 20 from the lower end thereof is considerably greater than in the case of the box connector FIG. 19. However, as previously discussed, since in each case the wall into which the longer box connector of FIG. 9 is to be incorporated or the wall into which the box connector of FIG. 20 is to be incorporated will each be seated on a supporting concrete base and the tie rods 3 extending upwardly therefrom will always extend well above the lower cored openings 23.

While the invention has been described with particular reference to the panels and box connectors and a particular modular dimension base, it will be understood that the invention is not limited thereto and it will be appreciated by those skilled in the art that variations may be made without departing from the spirit of the invention or the scope of the appended claims.

The embodiments of the invention in which an exclusive property or privilege is claimed are defined as follows:

1. Elongated thermoplastic hollow structural components which are of rectilinear cross section and which mate with one another to form an interlocking assembly used in erecting a modular building on a supporting base, each component comprising a coextrusion of a substrate containing reprocessed plastic material and a thin smooth thermoplastic skin on external surfaces of said substrate, said components having cored walls to be located internally of the assembly, said cored walls having wall portions removed therefrom to provide a predetermined pattern of holes which are spaced lengthwise of the cored walls and which register from one component to another to provide internal flow passages between the components when mated with one another, the wall portions removed from the cored walls providing a source of substrate reprocessed feed stock.

2. The structural thermoplastic components as claimed in claim 1 in which said thin skin is virgin thermoplastic material.

3. The structural thermoplastic components as claimed in claim 2 in which said skin is a polyvinyl chloride and said substrate includes up to about 16% reprocessed plastic material.

4. The structural components as claimed in claims 1, 2 or 3 in which said substrate has a polyvinyl base and further includes a reinforcing and expansion controlling constituent.

5. The structural components as claimed in claims 1, 2 or 3 in which said substrate has a polyvinyl base and further includes a reinforcing and expansion controlling constituent selected from one of calcium carbonate, mineral fibers, and short fine glass fibers.

6. The structural thermoplastic components as claimed in claim 1 in which said components are provided with opposing inwardly projecting interlock formations, said components being characterized in that said holes extend transversely substantially the width between said opposing inwardly projecting interlock formations and have a smoothly curved peripheral surface.

7. The structural components as claimed in claim 6 in which said holes have a rounded rectangular configuration and are symmetrical about axes extending transversely and longitudinally of each said component.

8. The structural components as claimed in claim 7 in which the peripheries of said holes are continuously curved.

9. The structural components as claimed in claim 6, 7 or 8 in which the spacing of said holes along the length of said components is a function of the desired roof slope of a modular building to be erected therefrom.

10. The structural components as claimed in claim 1 which include modular panels whose cored walls comprise transverse edge walls and at least one transverse internal web wall and said opposing interlocking formations comprise inwardly projecting opposing grooves adjacent said edge walls, characterized in that said panels are cored to provide said predetermined pattern of spaced holes in said edge walls and said at least one web wall.

11. The structural components as claimed in claim 10 in which said substrate contains a reinforcing and expansion controlling agent.

12. The structural components as claimed in claim 10 in which said substrate contains short fine glass fibers.

13. The structural components as claimed in claim 10 which include box connectors of square cross section having projecting flanges with internal locking fingers for interlocking engagement in the grooves of adjoining panels.

14. The components as claimed in claim 13 assembled into a building structure on a concrete base, said building structure having walls and a sloping roof, characterized in that said walls are filled with concrete interconnecting said panels and box connectors through said registering holes, reinforcing anchor rods are provided extending upwardly extending into said concrete filled walls from said concrete base and reinforcing bars are extended internally through at least some of the registering holes of said assembled components.

15. The structural components as claimed in claim 13 assembled to provide a wall opening to receive a door or window, characterized in that said components provide registering holes to receive reinforcing members projecting internally therethrough and bridging said opening.

16. The structural components as claimed in claim 13 characterized in that said holes in each said component lie wholly within its length.

17. The structural components as claimed in claims 4 or 16 in which the spacing between said holes is less than one-half the dimension of the holes in the direction of the longitudinal axis of said component.

18. The structural components as claimed in claim 1 characterized in that the volume of material cored from each said component is at least about 16 percent of the volume of the uncored component.

19. The structural components as claimed in claim 13 in which said box connectors include two way box connectors having a pair of spaced parallel sidewalls connected by a pair of spaced webs, said spaced sidewalls having flange extensions provided with opposing inturned locking fingers at the ends thereof at each side of said pair of spaced webs characterized in that said two way box connectors are formed from extrusion in which said sidewalls are concaved and are returned to parallelism by the coring thereof.

20. The structural components as claimed in claim 1 in which said components comprise extruded hollow panels having parallel sidewalls, edge walls, webs joining said sidewalls and opposing inwardly projecting grooves adjacent said edge walls and extruded hollow box connectors having sidewalls connected by webs with said sidewalls having flanged projections provided with opposing inturned fingers adapted to interlock in said panel grooves, said panels being cored to provide a pattern of spaced registering openings through said edge walls and said webs, and said box connectors being extruded with their sidewalls concaved and being cored to provide a pattern of spaced registering openings through said webs and to bring said concave sidewalls in parallelism whereby said panels and box connectors can be interlocked with a precision fit with said panel and box opening in registration.

21. The components as claimed in claim 19 in which said panel edge walls are concave.

22. The extruded thermoplastic hollow structural components as claimed in claim 20 assembled in interlocking relation to form a wall structure on a supporting concrete base and the anchored rods projecting upwardly into said box connectors and having concrete poured therein and having reinforcing bars projecting through said registering panel and box openings to tie said anchor rods together.

23. The components as claimed in claim 20 in which said pattern of spaced openings starts at a fixed distance from the upper ends of said components and ends short of the bottom ends thereof.

24. An elongated thermoplastic building component of rectilinear cross sections having spaced sidewalls connected at least by a pair of spaced webs and having at least one pair of opposing interlock elements extending inwardly between said sidewalls, said component being characterized in that it is formed from a coextrusion with concave sidewalls comprised of a core and outer skin, and said webs are cored to provide spaced openings therethrough along the length thereof to bring said sidewalls into substantially parallelism and said opposing interlock elements into opposing registration with a predetermined spacing therebetween.

25. The elongated thermoplastic building component as claimed in claim 24 in which said pair of opposing interlock elements comprise inturned fingers.

26. The elongated thermoplastic building component as claimed in claim 24 or 25 in which said core contains reinforcing constituents.

27. The elongated thermoplastic building component as claimed in claims 24 or 25 in which said core contains a reinforcing constituent selected from one of calcium carbonate, mineral fibers, and fine short glass fibers.

* * * * *